US005932959A

United States Patent [19]

Shimada et al.

[11] Patent Number: 5,932,959

[45] Date of Patent: Aug. 3, 1999

[54] DEFLECTION YOKE AND COLOR CATHODE RAY TUBE WITH DEFLECTION YOKE

[75] Inventors: Koji Shimada, Shiga; Akitsugu Ishii; Toshio Ose, both of Osaka, all of Japan

[73] Assignee: Matsushita Electronics Corporation, Osaka, Japan

[21] Appl. No.: 08/958,905

[22] Filed: Oct. 28, 1997

Related U.S. Application Data

[62] Division of application No. 08/520,484, Aug. 29, 1995, Pat. No. 5,783,901.

[30] Foreign Application Priority Data

Sep. 5, 1994 [JP] Japan ..... 6-211076
Sep. 5, 1994 [JP] Japan ..... 6-211551

[51] Int. Cl.[6] ..... H01J 29/70; H01J 29/50; H01J 29/46; H01H 1/00

[52] U.S. Cl. ..... 313/440; 313/413; 313/437; 313/442; 335/210; 335/213; 335/297; 335/299

[58] Field of Search ..... 313/421, 426, 313/429, 430–31, 432–37, 440–42, 477 R; 335/212, 213, 297, 299

[56] References Cited

U.S. PATENT DOCUMENTS 3,891,951 6/1975 Talsma .
3,913,042 10/1975 Talsma .
4,229,720 10/1980 Heijnemans et al. .
4,233,582 11/1980 Abe et al. .

FOREIGN PATENT DOCUMENTS 25 15 736 10/1976 Germany .
54-34712 3/1979 Japan .
61-168843 7/1986 Japan .
63-289748 11/1988 Japan .
2-204947 8/1990 Japan .
1 346 820 2/1974 United Kingdom .

*Primary Examiner*—Sandra O'Shea
*Assistant Examiner*—Mack Haynes
*Attorney, Agent, or Firm*—Merchant, Gould, Smith, Edell, Welter & Schmidt

[57] ABSTRACT

A deflection yoke for a cathode ray tube can correct both the pincushion distortion at the upper and lower edges of the screen and the misconvergence of the screen at the same time by the deflection yoke itself without the need for a correction magnet. The deflection yoke comprises a saddle shaped horizontal deflection coil, a saddle shaped vertical deflection coil located outside the horizontal deflection coil, and a high permeability core located outside the vertical deflection coil. The core has notch portions at the center parts of the upper and lower portions of the screen side end.

6 Claims, 17 Drawing Sheets

DEFLECTION YOKE AND COLOR CATHODE RAY TUBE WITH DEFLECTION YOKE

This is a divisional application of application Ser. No. 08/520,484, filed Aug. 29, 1995, now U.S. Pat. No. 5,783,901, issued Jul. 21, 1998.

BACKGROUND OF THE INVENTION

1. Field of the Invention

The present invention relates to deflection yokes and color cathode ray tubes with the deflection yokes.

2. Description of the Related Art

In the current color cathode ray tubes used in a display monitor as windows, information is very often displayed in the peripheral area of the screen. Therefore a technology enabling minute image display in such area is being called for. Since the raster distortion is an essential element in determining the image quality in the peripheral area of the screen, the standards for the pincushion distortion in the upper and lower edges of the screen or for the raster distortion which depend on the magnetic field distribution of the deflection yoke itself have become very demanding. Further, the demand to the convergence in the peripheral area of the screen has become very severe as well.

A self-convergence type deflection yoke used in a cathode ray tube having an inline electron gun comprises a saddle shaped horizontal deflection coil 24, a saddle shaped vertical deflection coil 25 located outside the horizontal deflection coil 24, and a high permeability core 26 located outside the vertical deflection coil 25 as illustrated in FIGS. 22 and 23. In such a self-convergence type deflection yoke, the magnetic field of the horizontal deflection coil 24 is designed to form a pincushion shape and the magnetic field of the vertical deflection coil 25 is designed to form a barrel shape in order to correct both the pincushion distortion at the upper and lower edges of the screen and the misconvergence on the screen at the same time.

With the trend of enlarging the curvature of cathode ray tubes in recent years, a "positive anisotropic astigmatism" as illustrated in FIG. 24 tends to emerge on the screen and at the same time the pincushion distortion at the upper and lower edges of the screen tends to increase.

The "positive anisotropic astigmatism" will be explained. In FIG. 24, the letters B, G, R, denote three electron beam irradiation sources viewed from the screen side. The broken line 27 denotes the blue pattern of the electron beam irradiated from the electron beam irradiation source B, the chain line 28 the red pattern of the electron beam irradiated from the electron beam irradiation source R, and the solid line 29 the green pattern of the electron beam irradiated from the electron beam irradiation source G, respectively. In the first quadrant of the upper right of the screen, the red pattern (chain line) 28 emerges to the downward and the blue pattern (broken line) 27 to the upward with respect to the green pattern (solid line) 29, with the red pattern (chain line) 28 and the blue pattern (broken line) 27 crossing on the vertical axis to form an X shape. In the second quadrant of the upper left of the screen, the position of the red pattern (chain line) 28 and the blue pattern (broken line) 27 is reversed with respect to the first quadrant. In the lower half of the screen, the position of the patterns is symmetrical with the horizontal axis as the line of symmetry. This is called the "positive anisotropic astigmatism".

In conventional self-convergence type deflection yokes, if the magnetic field of the vertical deflection coil 25 is formed as a stronger barrel shaped magnetic field to correct the positive anisotropic astigmatism in the screen, the pincushion distortion at the upper and lower edges of the screen further increases. Besides, if the magnetic field of the horizontal deflection coil 24 is formed as a stronger pincushion shaped magnetic field to correct the pincushion distortion at the upper and lower edges of the screen, the positive anisotropic astigmatism tends to further increase. Therefore, it is impossible to correct both the pincushion distortion at the upper and lower edges of the screen and the misconvergence of the screen at the same time.

In a deflection coil used in a deflection yoke, the magnetic field distribution from the screen side toward the electron gun side is concerned with the misconvergence correction on the screen as a whole, while the magnetic field distribution of the deflection coil at the screen side is concerned with the pincushion distortion at the upper and lower edges of the screen. This is because the distance between the electron beam and the deflection coil at the screen side is shorter than that at the electron gun side when deflecting the electron beam, and the effect of the magnetic field distribution of the screen side on the pincushion distortion at the upper and lower edges of the screen becomes greater at the screen side of the deflection coil for the electron beam passing on the tip of the curve of lines of magnetic force.

As heretofore mentioned, in order to correct the pincushion distortion at the upper and lower edges of the screen by means of a deflection yoke, the pincushion magnetic field at the screen side of the deflection coil should be strengthened. Further, in order to correct the misconvergence on the screen in the condition, the barrel magnetic field at the vicinity of the middle part and the electron gun side excluding the screen side of the deflection coil should be strengthened.

In order to meet such requirements, a method of achieving both the correction of the pincushion distortion at the upper and lower edges of the screen and the convergence by further providing correction magnets at the upper and lower parts of the screen side of the deflection yoke has been advocated as disclosed in the Japanese Patent Application Laid Open No. 204947/1990.

In a self-convergence type deflection yoke, the magnetic field of the horizontal deflection coil 24 has a strong pincushion distortion in order to eliminate the raster distortion at the upper and lower edges of the screen by designing the magnetic field distribution of the deflection yoke itself (see FIG. 14). However, when much fifth-order pincushion distortion is included therein, a high order raster distortion at the upper and lower edges called gullwing is generated. Since the gullwing deteriorates the visual image quality drastically, it should be prevented.

In order to meet such demands, a method of reducing gullwing at the upper and lower edges of the screen by forming a dent at the center of the screen side flange of the horizontal deflection coil is proposed in the U.S. Pat. No. 4,233,582. Another method of reducing the gullwing at the upper and lower edges of the screen by having the screen side flange of the horizontal deflection coil in a polygonal shape is advocated in the U.S. Pat. No. 4,229,720. Further, a method of reducing the gullwing at the upper and lower edges of the screen by providing correction magnets with a protruding part at the upper and lower parts of the screen side is proposed in the Japanese Patent Application Laid Open No. 289748/1988.

However, in the method disclosed in the Japanese Patent Application Laid Open No. 204947/1990, since the method aims at both the correction of the pincushion distortion at the upper and lower edges of the screen and the convergence by providing correction magnets, there are problems such as an increased number of parts, and the wide variation of the magnetization of correction magnets in the production process.

In the method disclosed in the U.S. Pat. No. 4,233,582, in the pressing process to provide a dent at the center of the screen side flange of the horizontal deflection coil, the excessive stretching of the coil wire could damage its insulation coating layer. Further, if a dent is formed too deep, since the dent comes in contact with the funnel portion of the cathode ray tube when the deflection yoke is attached to a cathode ray tube, there is a problem in production or designing that it is difficult to form a dent sufficient to eliminate the gullwing. Further, in the method disclosed in the U.S. Pat. No. 4,229,720, there is a problem in production in that a coil wire is liable to be deformed and damaged at the apexes of the polygon-shaped screen side flange of the horizontal deflection coil. In the method disclosed in the Japanese Patent Application Laid Open No. 289748/1988, there are problems such as the increased number of parts by providing correction magnets, or the wide variation of magnetization of correction magnets in the production process.

SUMMARY OF THE INVENTION

In order to solve the above mentioned problems of the conventional arts, an object of the present invention is to provide a deflection yoke which can correct both the pincushion distortion at the upper and lower edges of the screen and the misconvergence on the screen without further comprising a correction magnet. It is another object of the present invention to provide a deflection yoke which can sufficiently reduce the gullwing without damaging flange side coil wires of the horizontal deflection coil at the time of winding, or increasing the number of parts. It is a further object of the present invention to provide a color cathode ray tube which can correct both the pincushion distortion and the misconvergence and improve the image quality. It is another object of the present invention to provide a color cathode ray tube which can sufficiently reduce the gullwing and improve the image quality.

In order to achieve the above mentioned objects, a first aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein the magnetic reluctance at the center parts of the upper and lower portions of the screen side of the core is higher than that of the right and left portions.

In the above mentioned first aspect of deflection yokes of the present invention, it is preferable that notch portions are provided at the center parts of the upper and lower portions of the screen side of the core.

In the above mentioned first aspect of deflection yokes of the present invention, it is preferable that the thicknesses of the center parts of the upper and lower portions of the screen side end of the core are thinner than those of the right and left portions.

In the above mentioned first aspect of deflection yokes of the present invention, it is preferable that the material of the center parts of the upper and lower portions of the screen side end of the core has a permeability lower than that of the right and left portions.

A second aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein the magnetic reluctance of the center parts of the upper and lower portions of the screen side end and the electron gun side end of the core is higher than that of the right and left portions.

In the above mentioned second aspect of deflection yokes of the present invention, it is preferable that notches are provided at the center parts of the upper and lower portions of the screen side end and the electron gun side end of the core.

In the above mentioned second aspect of deflection yokes of the present invention, it is preferable that the thicknesses of the center parts of the upper and lower portions of the screen side end and the electron gun end of the core are thinner those that of the right and left portions.

In the above mentioned second aspect of deflection yokes of the present invention, it is preferable that the material of the center parts of the upper and lower portions of the screen side end and the electron gun side end of the core has a permeability lower than that of the right and left portions.

A first aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein the magnetic reluctance of the center parts of the upper and lower portions of the screen side end of the core is higher than that of the right and left portions.

In the above mentioned first aspect of color cathode ray tubes of the present invention, it is preferable that notch portions are provided at the center parts of the upper and lower portions of the screen side end of the core.

In the above mentioned first aspect of color cathode ray tubes of the present invention, it is preferable that the thicknesses of the center parts of the upper and lower portions of the screen side end of the core are thinner than those of the right and left portions.

In the above mentioned first aspect of color cathode ray tubes of the present invention, it is preferable that the material of the center parts of the upper and lower portions of the screen side end of the core has a permeability lower than that of the right and left portions.

A second aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein the magnetic reluctance of the center parts of the upper and lower portions of the screen side end and the electron gun side end of the core is higher than that of the right and left portions.

In the above mentioned second aspect of color cathode ray tubes of the present invention, it is preferable that notch portions are provided in the center parts of the upper and lower portions of the screen side end and the electron gun side end of the core.

In the above mentioned second aspect of color cathode ray tubes of the present invention, it is preferable that the thicknesses of the center parts of the upper and lower portions of the screen side end and the electron gun side end of the core are thinner than those of the right and left portions.

In the above mentioned second aspect of color cathode ray tubes of the present invention, it is preferable that the material of the center parts of the upper and lower portions of the screen side end and the electron gun side end of the core has a permeability lower than that of the right and left portions.

A third aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein at least one pair of portions with a magnetic reluctance higher than that of the right and left portions is provided at the screen side of the core, each in a region away from the horizontal axis by 35 degrees or more.

In the above mentioned third aspect of deflection yokes of the present invention, it is preferable that at least one pair of notch portions is provided at the screen side of the core, each in a region away from the horizontal axis by 35 degree or more.

In the above mentioned third aspect of deflection yokes of the present invention, it is preferable that at least one pair of portions with a thickness thinner than that of the right and left portions is provided at the screen side of the core, each in a region away from the horizontal axis by 35 degrees or more.

In the above mentioned third aspect of deflection yokes of the present invention, it is preferable that at least one pair of portions with a permeability lower than that of the right and left portions are provided at the screen side of the core, each in a region away from the horizontal axis by 35 degrees or more.

A third aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein at least one pair of portions with a magnetic reluctance higher than that of the right and left portions is provided at the screen side of the core, each in a region away from the horizontal axis by 35 degrees or more.

In the above mentioned third aspect of color cathode ray tubes of the present invention, it is preferable that at least one pair of notch portions is provided at the screen side of the core each in a region away from the horizontal axis by 35 degree or more.

In the above mentioned third aspect of color cathode ray tubes of the present invention, it is preferable that at least one pair of portions with a thickness thinner than that of the right and left portions is provided at the screen side of the core, each in a region away from the horizontal axis by 35 degrees or more.

In the above mentioned third aspect of color cathode ray tubes of the present invention, it is preferable that at least one pair of portions with a permeability lower than that of the right and left portions is provided at the screen side of the core, each in a region away from the horizontal axis by 35 degrees or more.

A fourth aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein at least one pair of portions with a magnetic reluctance lower than that of the right and left portions is provided at the screen side of the core, each in a region away from the horizontal axis by 35 degrees or more.

In the above mentioned fourth aspect of deflection yokes of the present invention, it is preferable that at least one pair of portions with a thickness thicker than that of the right and left portions is provided at the screen side of the core, each in a region away from the horizontal axis by 35 degrees or more.

In the above mentioned fourth aspect of deflection yokes of the present invention, it is preferable that at least one pair of portions with a permeability higher than that of the right and left portions is provided at the screen side of the core, each in a region away from the horizontal axis by 35 degrees or more.

A fourth aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein at least one pair of portions with a magnetic reluctance lower than that of the right and left portions is provided at the screen side of the core, each in a region away from the horizontal axis by 35 degrees or more.

In the above mentioned fourth aspect of color cathode ray tubes of the present invention, it is preferable that at least one pair of portions with a thickness thicker than that of the right and left portions is provided at the screen side of the core, each in a region away from the horizontal axis by 35 degrees or more.

In the above mentioned fourth aspect of color cathode ray tubes of the present invention, it is preferable that at least one pair of portions with a permeability higher than that of the right and left portions is provided at the screen side of the core, each in a region away from the horizontal axis by 35 degrees or more.

Since the above mentioned first aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein the magnetic reluctance at the center parts of the upper and lower portions of the screen side core is higher than that of the right and left portions, lines of magnetic force of the magnetic field yielded by the horizontal deflection coil can hardly pass through at the center parts of the upper and lower portions of the screen side of the core. Therefore the pincushion magnetic field of the screen side yielded by the core and the horizontal deflection coil curves, avoiding the center parts of the upper and lower portions of the screen side end of the core, and becomes stronger than the case with a conventional core and a horizontal deflection coil. That is, the pincushion shape magnetic field becomes stronger only at the screen side of the horizontal deflection coil. By this arrangement, the pincushion distortion at the upper and lower edges of the screen can be corrected without further requiring use of a correction magnet. As a result, the number of the parts can be reduced to decrease the production cost, and the concern about adjusting the magnetization variation of correction magnets in the production process becomes unnecessary. Since the misconvergence on the screen can be corrected by strengthening the barrel magnetic field yielded by the vertical deflection coil, the deflection yoke by itself can correct both the pincushion distortion at the upper and lower edges of the screen and the misconvergence on the screen.

In the preferable example of the above mentioned first aspect of deflection yokes of the present invention wherein notch portions are provided at the center parts of the upper and lower portions of the screen end of the core, the magnetic reluctance at the center parts of the upper and lower portions of the screen side of the core becomes higher than that of the right and left portions.

In the preferable example of the above mentioned first aspect of deflection yokes of the present invention wherein the thickness of the center parts of the upper and lower portions of the screen side end of the core is thinner than that of the right and left portions, the magnetic reluctance of the center parts of the upper and lower portions of the screen side of the core becomes higher than that of the right and left portions.

In the preferable example of the above mentioned first aspect of deflection yokes of the present invention wherein the material of the center parts of the upper and lower portions of the screen side end of the core has a permeability lower than that of the right and left portions, the magnetic reluctance of the center parts of the upper and lower portions of the screen side of the core becomes higher than that of the right and left portions.

Since the second aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein the magnetic reluctance of the center parts of the upper and lower portions of the screen side end and the electron gun side end of the core is higher than that of the right and left portions, the effusion of the magnetic field yielded by the horizontal deflection coil from the deflection yoke decreases. As a result, as in the above mentioned first aspect of deflection yokes of the present invention, both the pincushion distortion of the upper and lower edges of the screen and the misconvergence of the screen can be corrected at the same time by itself, and the magnetic field leakage at the screen side and the electron gun side can be reduced without further requiring use of a cancel coil or a magnetic substance.

Since the above mentioned first aspect of color cathode ray tubes of the present invention comprises a self-convergence type deflection yoke which comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein the magnetic reluctance at the center parts of the upper and lower portions of the screen side end of the core is higher than that of the right and left portions, the following advantages can be achieved. That is, by using the deflection yoke of the first aspect of the present invention, since both the pincushion distortion at the upper and lower edges of the screen and the misconvergence of the screen can be corrected at the same time by itself as mentioned above, the image quality of the color cathode ray tube can be improved.

Since the second aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein the magnetic reluctance of the center parts of the upper and lower portions of the screen side end of the core is higher than that of the right and left portions, the following advantages can be achieved. That is, since the deflection yoke of the second aspect of the present invention is used, both the pincushion distortion of the upper and lower edges of the screen and the misconvergence of the screen can be corrected at the at the same time by it self, and the magnetic field leakage at the screen side and the electron gun side is reduced, the image quality of the color cathode ray tube can be improved.

Since the third aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein at least one pair of portions with a magnetic reluctance higher than that of the right and left portions is provided at the screen side of the core, each in a region away from the horizontal axis by 35 degrees or more, lines of magnetic force of the horizontal deflection magnetic field can hardly pass through at the portions with a magnetic reluctance higher than that of the right and left portions. Thus, the pincushion magnetic field of the screen side yielded by the core and the horizontal deflection coil curves, avoiding the portions with a magnetic reluctance higher than that of the right and left portions and thus the pincushion distortion of the horizontal deflection magnetic field becomes greater. Therefore compared with the case with a conventional core and a horizontal deflection coil, the magnetic field distribution at the screen side yielded by the horizontal deflection coil can be controlled easily. By this, a high order raster distortion (gullwing) of the upper and lower edges of the screen can be sufficiently reduced without changing the shape of the screen side flange of the horizontal deflection coil. As a result, the coil wires of the screen side flange will not be damaged at the time of winding the horizontal deflection coil. Further, since the gullwing can be sufficiently reduced without providing a correction magnet, the number of parts can be reduced to decrease the production cost and concern about the variation of magnetization of a correction magnet in the production process becomes unnecessary.

In the preferable example of the above mentioned third aspect of deflection yokes of the present invention wherein at least one pair of notch portions is provided at the screen side of the core, each in a region away from the horizontal axis by 35 degree or more, since the magnetic reluctance becomes higher at the notch portions, the magnetic field distribution at the screen side of the horizontal deflection coil can be controlled easily.

In the preferable example of the above mentioned third aspect of deflection yokes of the present invention wherein at least one pair of portions with a thickness thinner than that of the right and left portions is provided at the screen side of the core, each in a region away from the horizontal axis by 35 degrees or more, the magnetic reluctance becomes greater at the portions with a thinner thickness, and the magnetic field distribution at the screen side of the horizontal deflection coil can be controlled easily.

In the preferable example of the above mentioned third aspect of deflection yokes of the present invention wherein at least one pair of portions with a permeability lower than that of the right and left portions is provided at the screen side of the core in a region away from the horizontal axis by 35 degrees or more, since the magnetic reluctance becomes greater at the portions having a smaller permeability, the magnetic field distribution at the screen side of the horizontal deflection coil can be controlled easily.

Since the above mentioned third aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein at least one pair of portions with a magnetic reluctance higher than that of the right and left portions is provided at the screen side of the core, each in a region away from the horizontal axis, the following advantages can be achieved. That is, since the deflection yoke of the third aspect of the present invention is used and a high order raster distortion (gullwing) at the upper and lower edges of the screen can be sufficiently reduced as mentioned above, the image quality of the color cathode ray tube can be improved.

Since the above mentioned fourth aspect of deflection yokes of the present invention is a self-convergence type deflection yoke comprising at least a saddle shaped horizontal deflection coil, a saddle shaped vertical deflection coil located outside the saddle shaped horizontal deflection coil and a core located outside the saddle shaped vertical deflection coil, wherein at least one pair of portions with a magnetic reluctance lower than that of the right and left portions is provided at the screen side of the core, each in a region away from the horizontal axis by 35 degrees or more, lines of magnetic force of the horizontal deflection magnetic field can easily pass through the portions with a magnetic reluctance lower than the right and left portions. As a result, the screen side pincushion magnetic field yielded by the core and the horizontal deflection coil curves toward the portions having a lower magnetic reluctance, and the pincushion distortion of the horizontal deflection magnetic field becomes smaller. Therefore, compared with the case using a conventional core and a horizontal deflection coil, the screen side magnetic field distribution of the horizontal deflection coil can be controlled easily. By this arrangement, a high order raster distortion (gullwing) at the upper and lower edges of the screen can be sufficiently reduced without changing the shape of the screen side flange portion of the horizontal deflection coil. As a consequence, coil wires of the screen side flange portion would not be damaged at the time of winding the horizontal deflection coil. Further, since the gullwing can be sufficiently reduced without a correction magnet, the number of parts can be reduced to reduce the production cost, and the concern about the magnetization variation of a correction magnet in production process becomes unnecessary.

In the above mentioned preferable embodiment of the fourth aspect of deflection yokes of the present invention wherein at least one pair of portions with a thickness thicker than that of the right and left portions is provided at the screen side of the core, each in a region away from the horizontal axis by 35 degrees or more, since the magnetic reluctance becomes lower in the thicker portions, the screen side magnetic field distribution yielded by the horizontal deflection coil can be easily controlled.

In the above mentioned preferable embodiment of the fourth aspect of deflection yokes of the present invention wherein at least one pair of portions with a permeability higher than that of the right and left portions is provided at the screen side of the core, each in a region away from the horizontal axis by 35 degrees or more, since the magnetic reluctance becomes lower at the portions having a smaller permeability, the screen side magnetic field distribution of the horizontal deflection coil can be easily controlled.

Since the above mentioned fourth aspect of color cathode ray tubes of the present invention comprises a valve comprising a glass panel and a glass funnel connected to the rear part of the glass panel, an electron gun located in the rear part of the valve, and a self-convergence type deflection yoke comprising at least a saddle shaped horizontal deflection coil located at the rear periphery of the valve, a saddle shaped vertical deflection coil located outside the saddle shaped horizontal deflection coil and a core located outside the saddle shaped vertical deflection coil, wherein at least one pair of portions with a magnetic reluctance lower than that of the right and left portions is provided at the screen side of the core, each in a region away from the horizontal axis by 35 degrees or more, the following advantages can be achieved. That is, since the deflection yoke of the fourth aspect of the present invention is used, since a high order raster distortion (gullwing) at the upper and lower edges of the screen can be sufficiently reduced as mentioned above, the image quality of the color cathode ray tube can be improved.

DETAILED DESCRIPTION OF THE INVENTION

The present invention will be further explained with reference to Examples.

EXAMPLE 1

Figure 1:
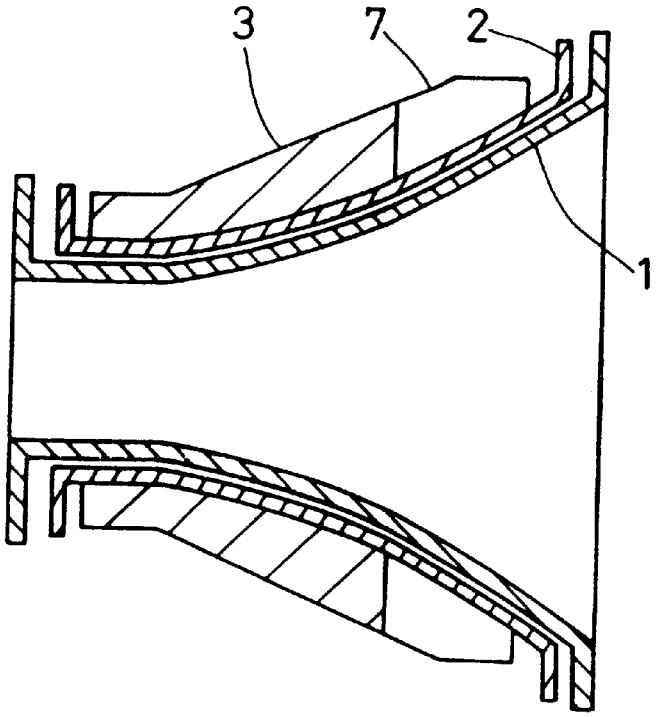
FIG. 1 is a side section view of deflection yokes of Example 1 (saddle-saddle shaped deflection yoke) of the present invention.
Figure 2:
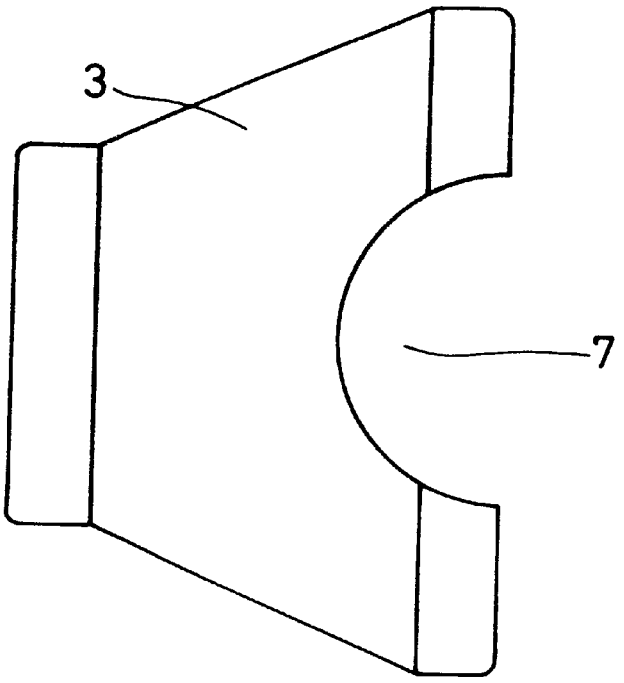
FIG. 2 is a plan view of the core in Example 1 of the present invention.

FIG. 1 is a side section view (saddle—saddle shaped deflection yoke) of deflection yokes of Example 1 of the present invention and FIG. 2 is a plan view of the core of Example 1 of the present invention. As described in FIG. 1, the deflection yoke comprises a saddle shaped horizontal deflection coil 1, a saddle shaped vertical deflection coil 2 located outside the horizontal deflection coil 1, and a high permeability core 3 located outside the vertical deflection coil 2.

As illustrated in FIGS. 1 and 2, the core 3 comprises notch portions 7 at the center parts of the upper and lower portions of the screen side end. The notch portions 7 form a half round shape with 28 mm radius.

Figure 3:
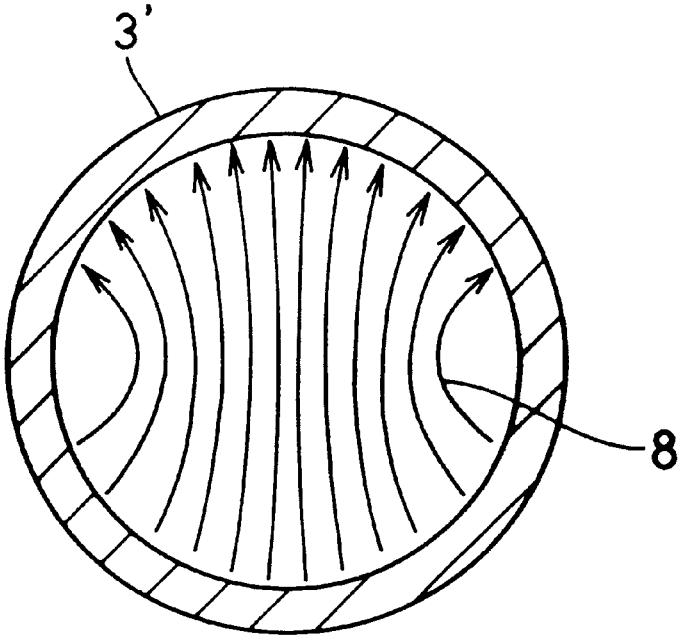
FIG. 3 is a section view of the vicinity of the screen side end illustrating the shape of the pincushion magnetic field of a conventional core and a horizontal deflection coil.
Figure 4:
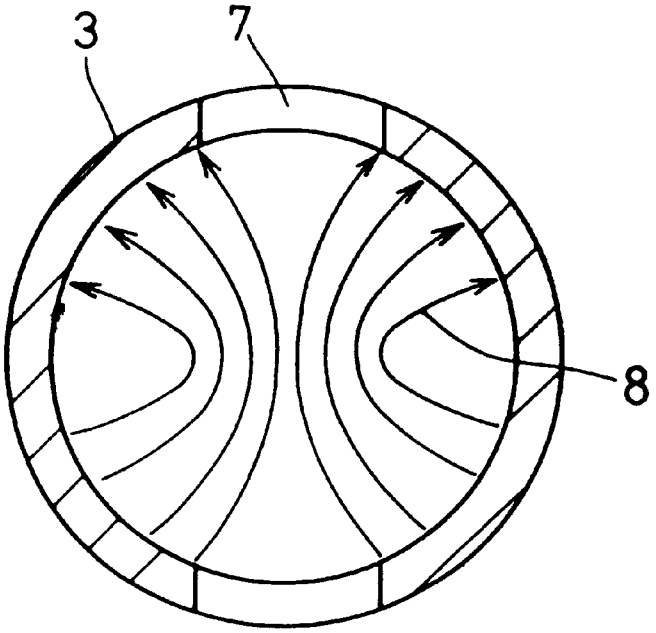
FIG. 4 is a section view of the vicinity of the screen side end illustrating the shape of the pincushion magnetic field of the core and the horizontal deflection coil of Example 1 of the present invention.

The shape of the pincushion magnetic field of the horizontal deflection coil 1 and a conventional core 3' is illustrated in FIG. 3 and the shape of the pincushion magnetic field of the horizontal deflection coil 1 and the core 3 comprising the notch portions 7 at the center parts of the upper and lower portions of the screen side end is illustrated in FIG. 4. FIGS. 3 and 4 are viewed from the screen side. Since the notch portions 7 are provided at the center parts of the upper and lower portions of the screen side end to increase the magnetic reluctance at the notch portions 7, lines of magnetic force of the horizontal deflection magnetic field 8 can hardly pass through. Therefore, the pincushion magnetic field (horizontal deflection magnetic field 8) at the screen side of the horizontal deflection coil 1 and the core 3 curves, avoiding the notch portions 7 as illustrated in FIG. 4, and becomes stronger than that of the case with the horizontal deflection coil 1 and a conventional core 3' as illustrated in FIG. 3. That is, the pincushion magnetic field is intensified only at the screen side of the horizontal deflection coil 1. By this arrangement, the pincushion distortion at the upper and lower edges of the screen can be corrected without comprising a correction magnet. As a consequence, the parts number is reduced, decreasing the production cost and eliminating the concern about the magnetization variation of the correction magnet in the production process. In particular, when the notch portions 7 are formed to be a half round shape with 28 mm radius as mentioned above, the pincushion distortion at the upper and lower edges of the image receptor plane of a color television set can be alleviated from 4% to nearly 0%. Further, since the misconvergence of the screen can be corrected by strengthening the barrel magnetic field yielded by the vertical deflection coil 2, both pincushion distortion at the upper and lower edges of the screen and the misconvergence of the screen can be corrected by the deflection yoke itself.

Figure 5:
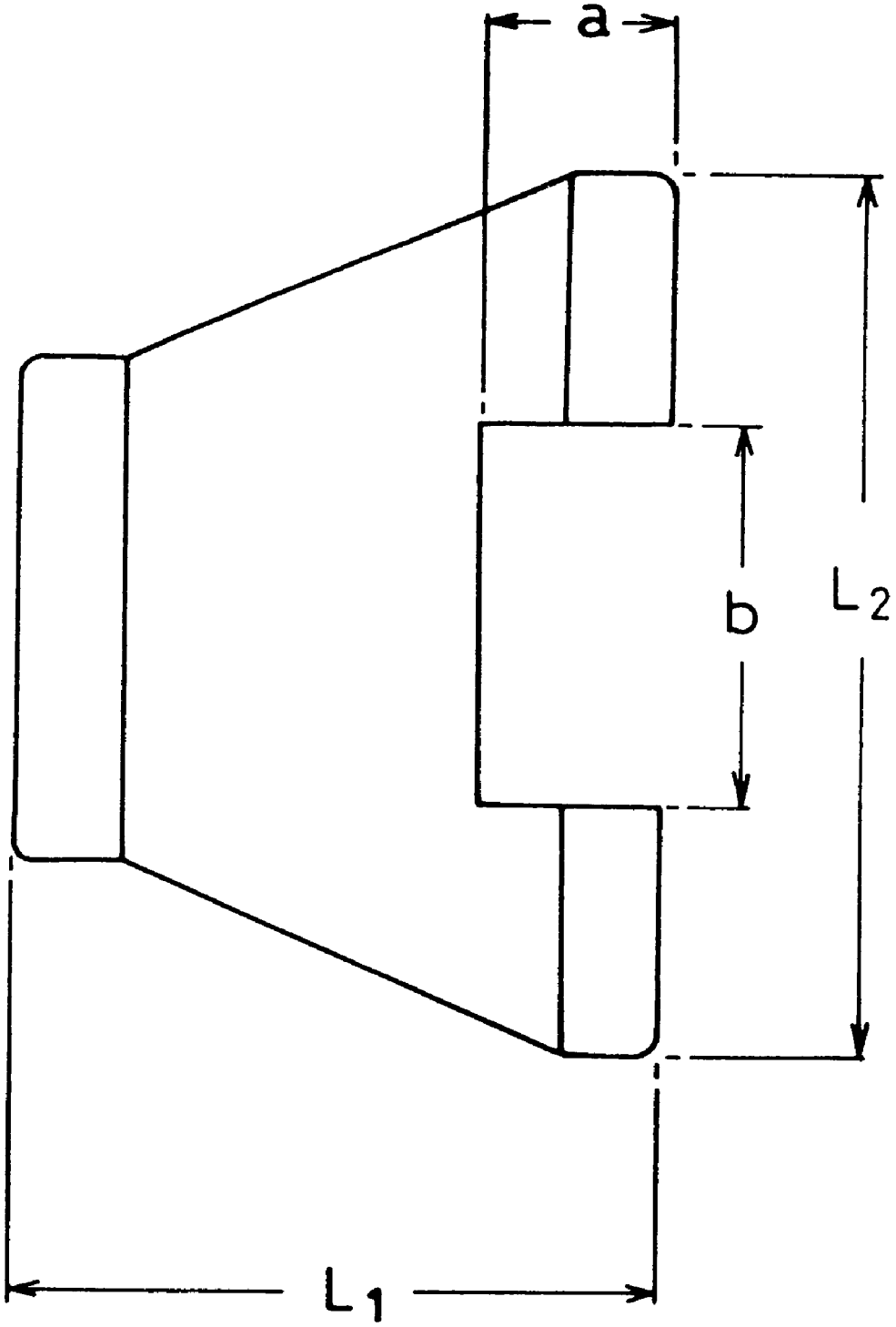
FIG. 5 is a plan view of another embodiment of cores of deflection yokes of Example 1 of the present invention.

Although the notch portions 7 are formed to be a half round shape with 28 mm radius in this Example, the size of a radius is not limited thereto and can be optionally selected. Further, the shape of the notch portions is not limited thereto, and the same effect can be obtained with an optional shape. In particular, when the notch portions have a rectangular shape as illustrated in FIG. 5, it is preferable that $0<a/L_1 \leqq 0.5$, $0<b/L_2 \leqq 0.7$ ($L_1$: overall length of the core, $L_2$: the maximum horizontal length of the screen side aperture portion of the core, a, b: lengths of the sides of the rectangle).

Although the notch portions 7 are provided as the means to increase the magnetic reluctance in this Example, the notch portions 7 are not prerequisite. And if only the magnetic reluctance of the center parts of the upper and lower portions of the screen side end of the core is increased to become stronger than that of the right and left portions, only the horizontal deflection magnetic field is strengthened without affecting the distribution of the vertical deflection magnetic field with respect to lines of magnetic force in the screen end of the core. Other embodiments will be illustrated in the following Example 2 and Example 3.

EXAMPLE 2

Figure 6:
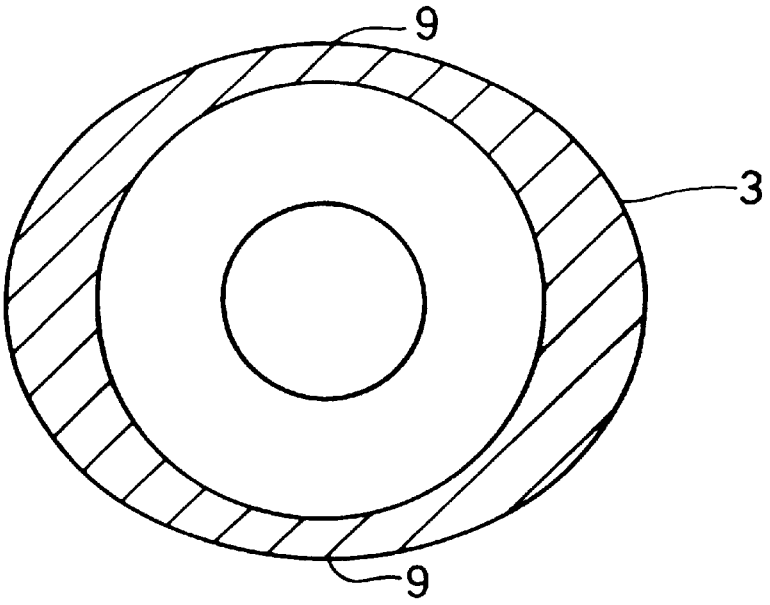
FIG. 6 is a section view of the vicinity of the screen side end of the core of Example 2 of deflection yokes of the present invention.

FIG. 6 is a section view of the vicinity of the screen side end of the core of deflection yokes of Example 2 of the present invention. As described in FIG. 6, the center parts of the upper and lower portions of the screen side end 9 of the core 3 are thinner than the right and left portions. Since other structures are the same as those of Example 1, detailed explanation is omitted (see FIG. 1). Since the magnetic reluctance becomes greater at the thinner portions, by forming only the center parts of the upper and lower portions of the screen side end 9 thinner than the right and left portions, lines of magnetic force of the horizontal deflection magnetic field can hardly pass through. As a consequence, the same effect as the case of forming notch portions 7 in the above mentioned Example 1 can be obtained.

EXAMPLE 3

Figure 7:
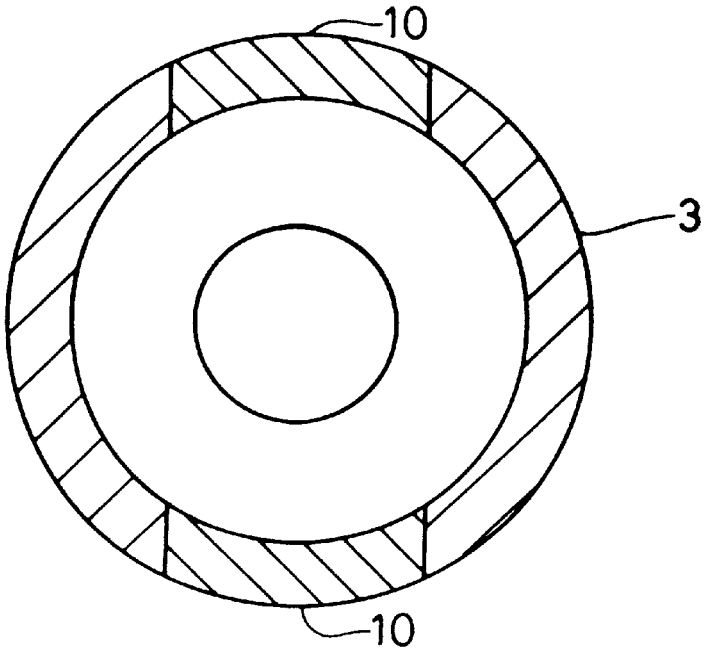
FIG. 7 is a section view of the vicinity of the screen side end of the core of Example 3 of deflection yokes of the present invention.

FIG. 7 is a section view of the vicinity of the screen side end of the core of Example 3 of deflection yokes of the present invention. As described in FIG. 7, the center parts of the upper and lower portions of the screen side end 10 of the core 3 comprise a material having a permeability lower than that of the material of the right and left portions. Since other structures are the same as those of Example 1, detailed explanation is omitted (see FIG. 1). For example, by using a ferrite core (Mg—Zn) as the core 3 and forming only the center parts of the upper and lower portions of the screen side end 10 with a material having a different mixing ratio to have a lower permeability, the structure of this Example can be realized. For example, the whole portion of the core 3 can be formed with H4L (manufactured by TDK; permeability $\mu_1$=500) and the center parts of the upper and lower portions of the screen side end 10 with H4M (manufactured by TDK; permeability $\mu_2$=320) or with H4H (manufactured by TDK; permeability $\mu u_3$=400). Since the magnetic reluctance becomes greater at the portions having a low permeability, if the center parts of the upper and lower portions of the screen side end 10 are formed with a material having a permeability lower than that of the right and left portions, lines of magnetic force of the horizontal deflection magnetic field can hardly pass through. As a consequence, the same effect as the case of forming notch portions 7 in the above mentioned Example 1 can be obtained.

EXAMPLE 4

Figure 8:
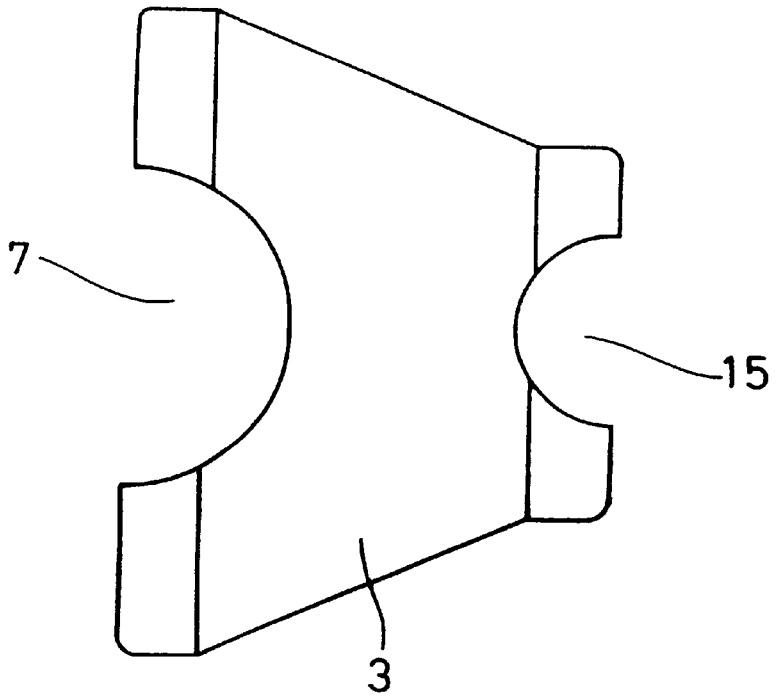
FIG. 8 is a plan view of the core of Example 4 of deflection yokes of the present invention.

FIG. 8 is a plan view of the core of deflection yokes of Example 4 of the present invention. As described in FIG. 8, the notch portions 7, 15 are formed at the center parts of the upper and lower portions of the screen side end and the electron gun side end in the core 3. Since other structures are the same as those of the above mentioned Example 1, detailed explanation is omitted (see FIG. 1).

Figure 9:
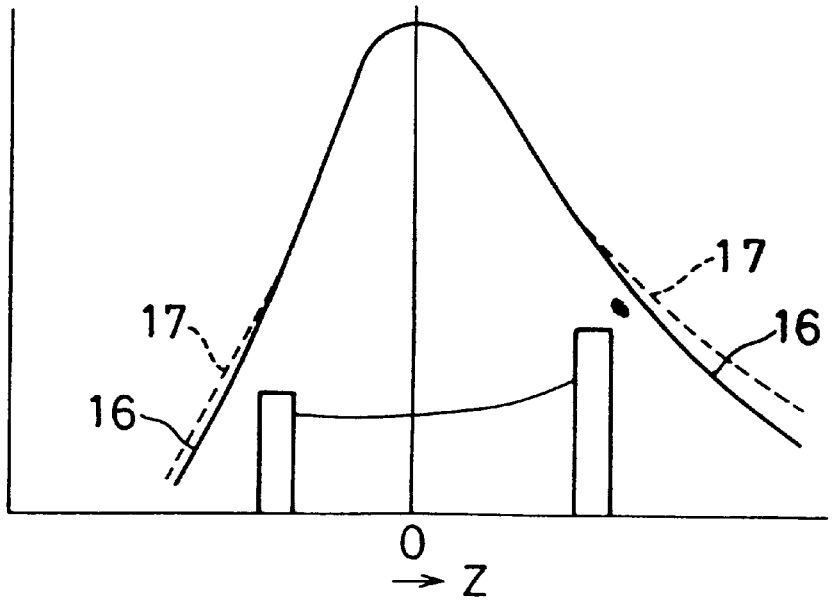
FIG. 9 is a graph illustrating the leaked magnetic fields of a conventional deflection yoke and of a deflection yoke comprising the core of Example 4 of the present invention.

FIG. 9 illustrates the magnetic field strength on the central axis of a conventional deflection yoke and a deflection yoke comprising the core 3 of this Example. In FIG. 9, the curved line 16 illustrates the case of a deflection yoke with the core 3 of this Example and the curved line 17 illustrates the case of a conventional deflection yoke. In comparison, the curves are almost identical in the vicinity of the peak, but the deflection yoke with the core 3 of this Example has a lower value than the conventional deflection yoke at the screen side and the electron gun side, thereby proving the decrease of leaked magnetic field at the screen side and the electron gun side. This is because the magnetic reluctance becomes greater at the notch portions 7, 15 to decrease the effusion of the magnetic field yielded by the horizontal deflection coil 1 from the deflection yoke by forming the notch portions 7, 15 at the center parts of the upper and lower portions at the screen side end and the electron gun side end of the core 3. When the notch portions 7, 15 of a half round shape with 28 mm radius and 10 mm radius respectively, are formed at center parts of the upper and lower portions of the screen side end and the electron gun side end, the leaked magnetic field is reduced to 35% of that found in conventional arts.

By forming a deflection yoke with the structure of this Example, as described in the above mentioned Example 1, the pincushion distortion at the upper and lower edges of the screen and the misconvergence of the screen can be both corrected by a deflection yoke itself and the leaked magnetic field at the screen side and the electron gun side can be reduced.

Figure 10:
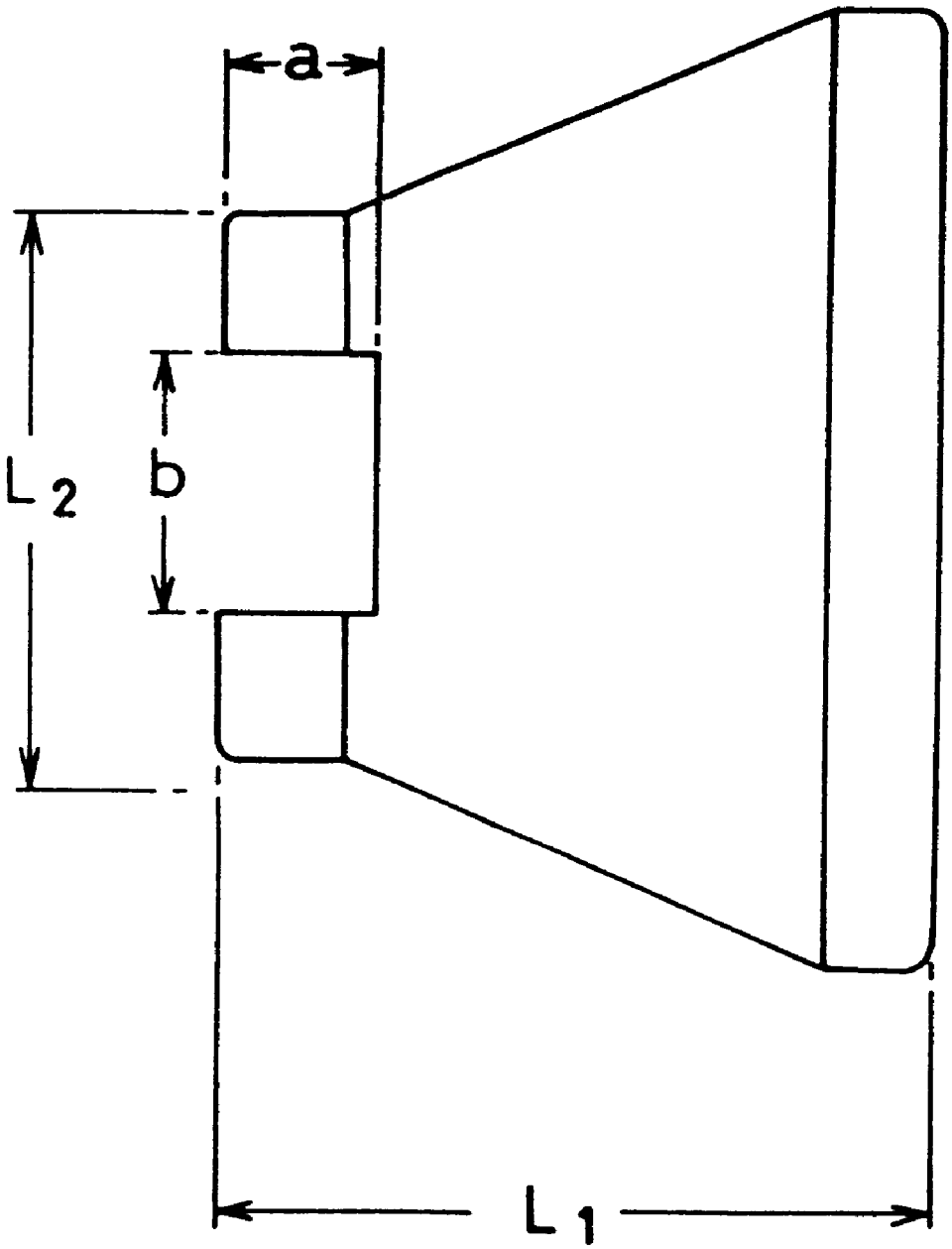
FIG. 10 is a plan view of another embodiment of cores of deflection yokes of Example 4 of the present invention.

Although the notch portions 7 have a half round shape with 28 mm radius and the notch portions 15 have a half round shape with 10 mm radium in this Example, the size of the radius is not limited thereto and can be selected optionally. Further, the shape of the notch portions is not limited to a half round shape, and the same effect can be achieved with an optional shape. In particular, when the notch portions have a rectangular shape as illustrated in FIG. 10, it is preferable that $0<a/L_1 \leqq 0.2$, $0<b/L_2 \leqq 0.35$ ($L_1$: overall length of the core, $L_2$: the maximum horizontal length of the screen side aperture portion of the core, a, b: lengths of the sides of the rectangle). Since the case with notch portions 7 of a rectangular shape is already explained in the above mentioned Example 1, further explanation is omitted.

Although the notch portions 7, 15 are provided as the means to reduce the leaked magnetic field at the screen side and the electron gun side in this Example, the notch portions 7, 15 are not prerequisite, and as long as the magnetic reluctance of the center parts of the upper and lower portions at the screen side end and the electron gun side end of the core 3 is greater than that of the right and left portions, the effect can be achieved. That is, for example, the center parts of the upper and lower portions of the screen side end and the electron gun side end of the core 3 can be formed thinner than the right and left portions as described in the above mentioned Example 2, or the center parts of the upper and lower portions at the screen side end and the electron gun side end of the core 3 can be formed with a material having a permeability lower than that of the material of the right and left portions as described in the above mentioned Example 3.

EXAMPLE 5

Figure 11:
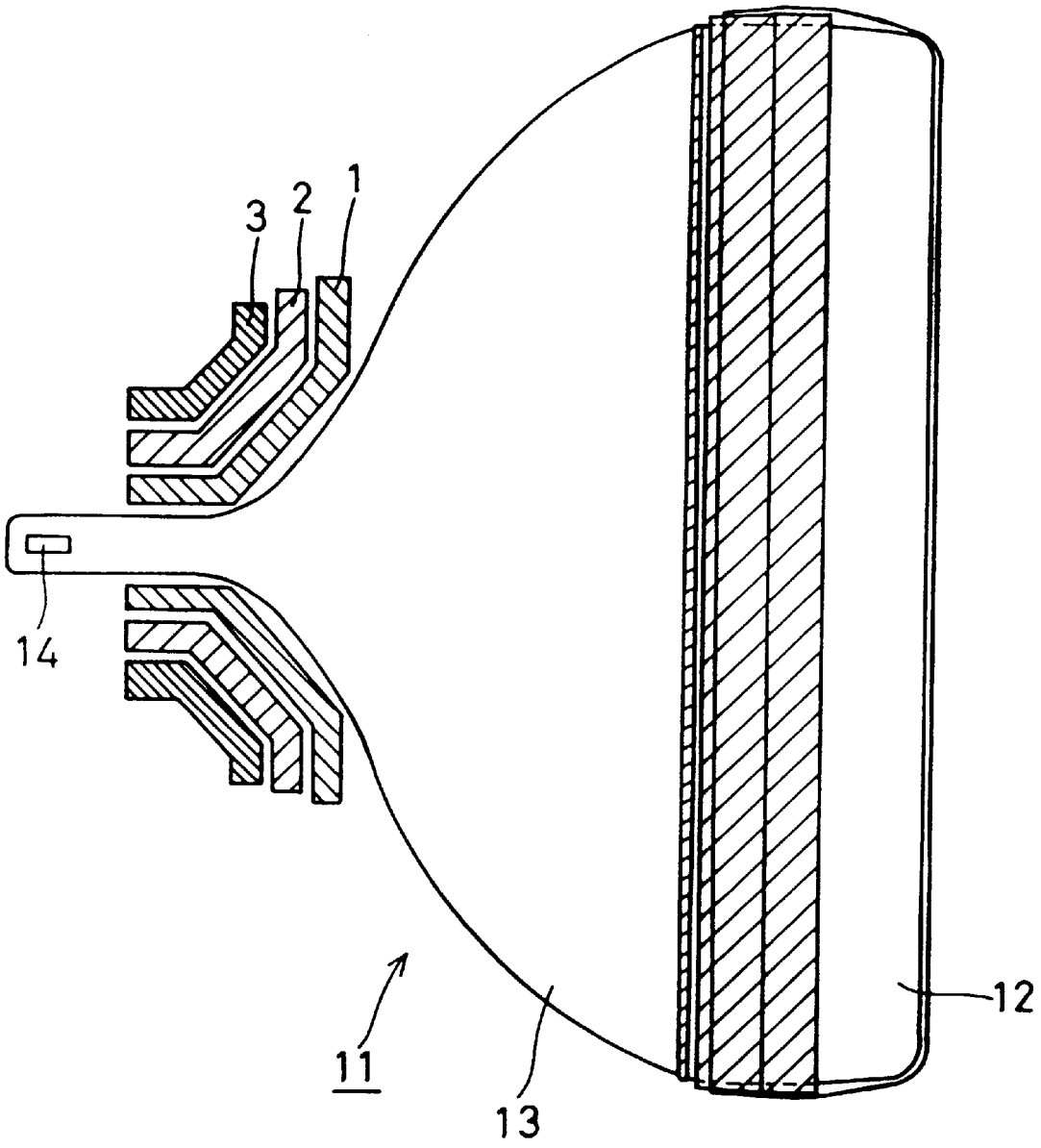
FIG. 11 is a plan view of color cathode ray tubes of Example 5 of the present invention.

FIG. 11 is a plan view illustrating Example 5 of color cathode ray tubes of the present invention. As described in FIG. 11, the valve 11 comprises a glass panel 12 and a glass funnel 13 connected to the rear part of the glass panel 12, and an electron gun 14 is provided in the rear part of the glass funnel 13. Further, a self-convergence type deflection yoke comprising a saddle shaped horizontal deflection coil 1, a saddle shaped vertical deflection coil 2 located outside the horizontal deflection coil 1, and a high permeability core 3 located outside the saddle shaped vertical deflection coil 2 is attached to the rear periphery of the glass funnel 13. Notch portions 7 are provided to the core 3 in the center parts of the upper and lower portions of the screen side end (see FIGS. 1 and 2). The notch portions 7 have a half round shape with 28 mm radius. That is, the deflection yoke of the above mentioned Example 1 is used in the color cathode ray tube of this Example. Since the pincushion distortion at the upper and lower edges of the screen and the misconvergence of the screen can be corrected at the same time as described above by using the deflection yoke of the above mentioned Example 1, the image quality of the color cathode ray tube can be improved.

Although an embodiment using the deflection yoke of the above mentioned Example 1 is described in this Example, the structure is not limited thereto. And a deflection yoke with the magnetic reluctance of the center parts of the upper and lower portions of the screen side end of the core being increased to be stronger than that of the right and left portions in order to strengthen only the horizontal deflection magnetic field without affecting the distribution of the vertical deflection magnetic field with respect to lines of magnetic force in the screen side core can be used. That is, the deflection yokes illustrated in the above mentioned Examples 2 and 3 can be used as well. Further, if the deflection yoke of the above mentioned Example 4 is used, since the leaked magnetic field at the screen side and the electron gun side can be reduced, unnecessary irradiation which might cause an adverse effect on a human body can be reduced to secure the safe environment.

EXAMPLE 6

Figure 12:
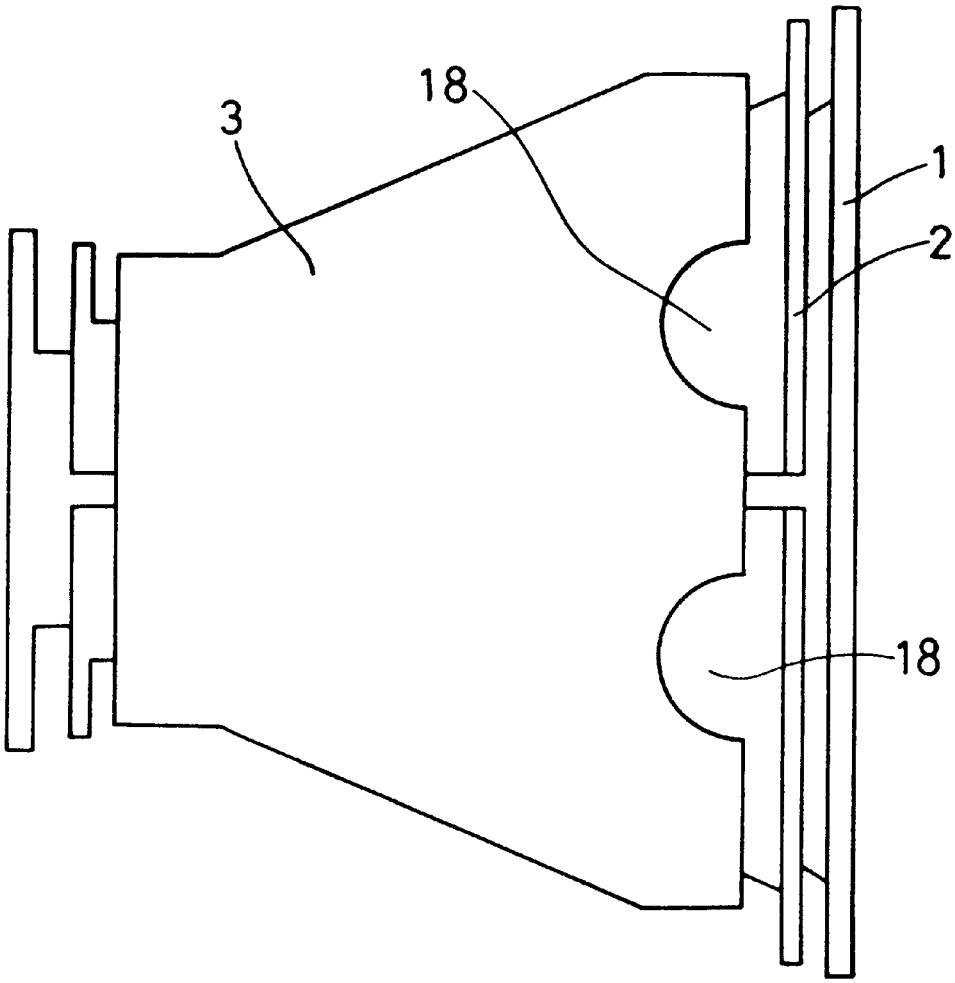
FIG. 12 is a plan view of deflection yokes of Example 6 (saddle-saddle shaped deflection yoke) of the present invention.
Figure 13:
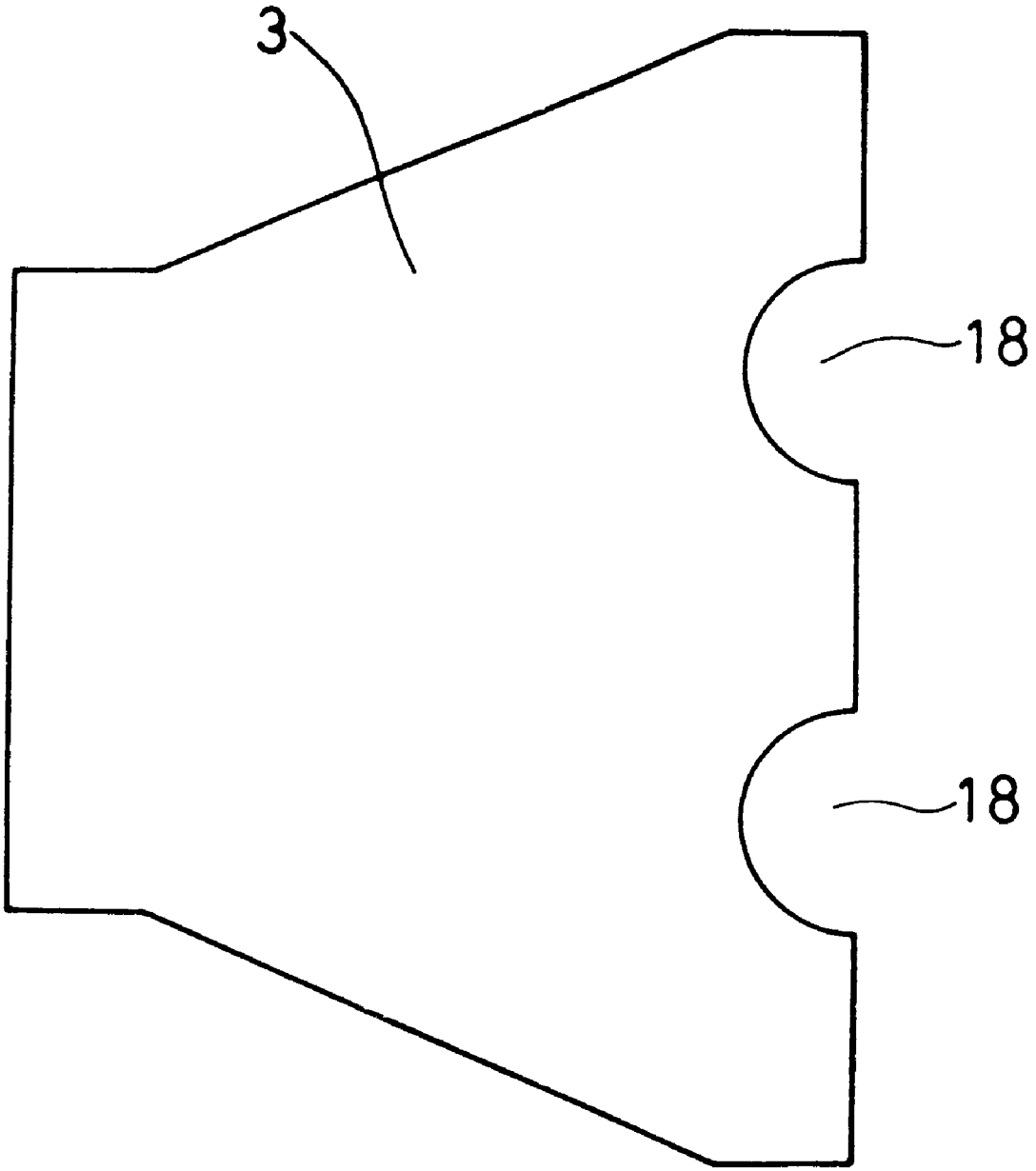
FIG. 13 is a plan view of the core of Example 6 of the present invention.

FIG. 12 is a plan view illustrating deflection yokes of Example 6 (saddle-saddle shaped deflection yoke) of the present invention, and FIG. 13 is a plan view of the core of Example 6 of the present invention. As described in FIG. 12, the deflection yoke comprises a saddle shaped horizontal deflection coil 1, a vertical deflection coil 2 located outside the horizontal deflection coil 1 and a high permeability core 3 located outside the vertical deflection coil 2.

Figure 15:
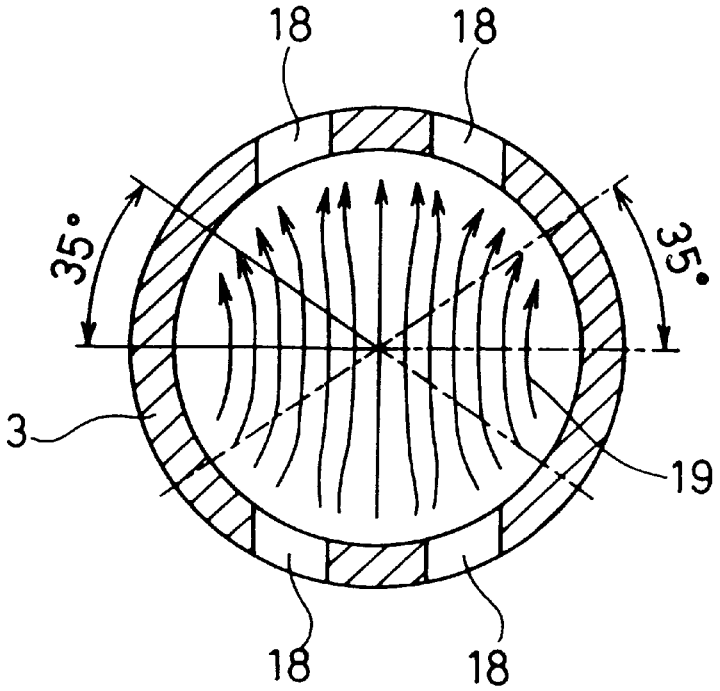
FIG. 15 is a section view of the vicinity of the screen side end illustrating the shape of the pincushion magnetic field of the core and the horizontal deflection coil of Example 6 of the present invention.

As described in FIGS. 12 and 13, the core 3 has a pair of notch portions 18 provided in the screen side, each in a region away from the horizontal axis by 35 degrees or more (see FIG. 15). The notch portions 18 have a half round shape with 10 mm radius.

Figure 14:
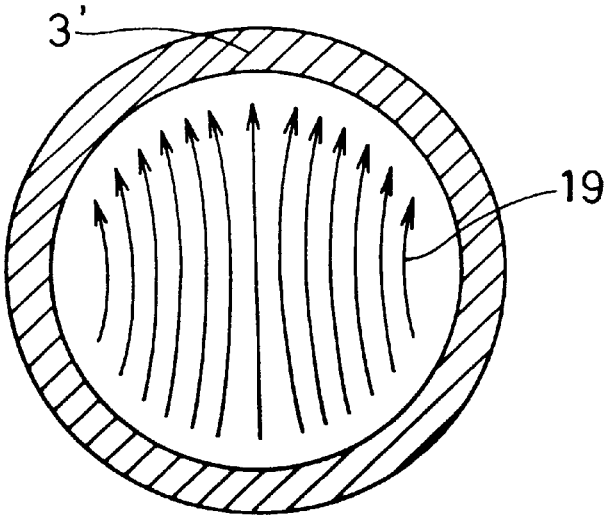
FIG. 14 is a section view of the vicinity of the screen side end illustrating the shape of the pincushion magnetic field of a conventional core and a horizontal deflection coil.

The shape of the pincushion magnetic field of the horizontal deflection coil 1 with a conventional core 3' is illustrated in FIG. 14 and the shape of the pincushion magnetic field of the horizontal deflection coil 1 with the core 3 having a pair of notch portions 18 provided in the screen side, each in a region away from the horizontal axis by 35 degrees or more, is illustrated in FIG. 15. FIGS. 14 and 15 are viewed from the screen side. Since the magnetic reluctance becomes greater at the notch portions 18, by providing a pair of notch portions 18 in the screen side of the core, each in a region away from the horizontal axis by 35 degrees or more, lines of magnetic force of the horizontal deflection magnetic field 19 can hardly pass through. By this arrangement, the pincushion magnetic field at the screen side yielded by the horizontal deflection coil 1 with the core 3 curves, avoiding the notch portions 18 to increase the pincushion distortion of the horizontal deflection magnetic field 19 as illustrated in FIG. 15. Therefore, compared with the case with the horizontal deflection coil 1 with a conventional core 3' (FIG. 14), the magnetic field distribution at the screen side yielded by the horizontal deflection coil 1 can be easily controlled. Accordingly, a high order raster distortion (gullwing) at the upper and lower edges of the screen can be sufficiently reduced without changing the shape of the screen side flange portion of the horizontal deflection coil 1. As a consequence, coil wires of the screen side flange portion can avoid the risk of the damage during winding the horizontal deflection coil 1. Further, since the gullwing can be sufficiently reduced without using a correction magnet, the parts number can be reduced to decrease the production cost, and the concern about the magnetization variation of the correction magnet in the production process is eliminated. For example, when notch portions 18 have a half round shape with 10 mm radius as mentioned above, the gullwing at the image receptor plane of the color television set can be alleviated from 1% to almost 0%.

Although a pair of notch portions 18 is provided at the screen side of the core, each in a region away from the horizontal axis by 35 degree or more in this Example, the number of notch portions is not limited thereto. When more than one pair of notch portions 18 are provided, the magnetic field distribution at the screen side of the horizontal deflection coil 1 can be controlled even more minutely.

Figure 16:
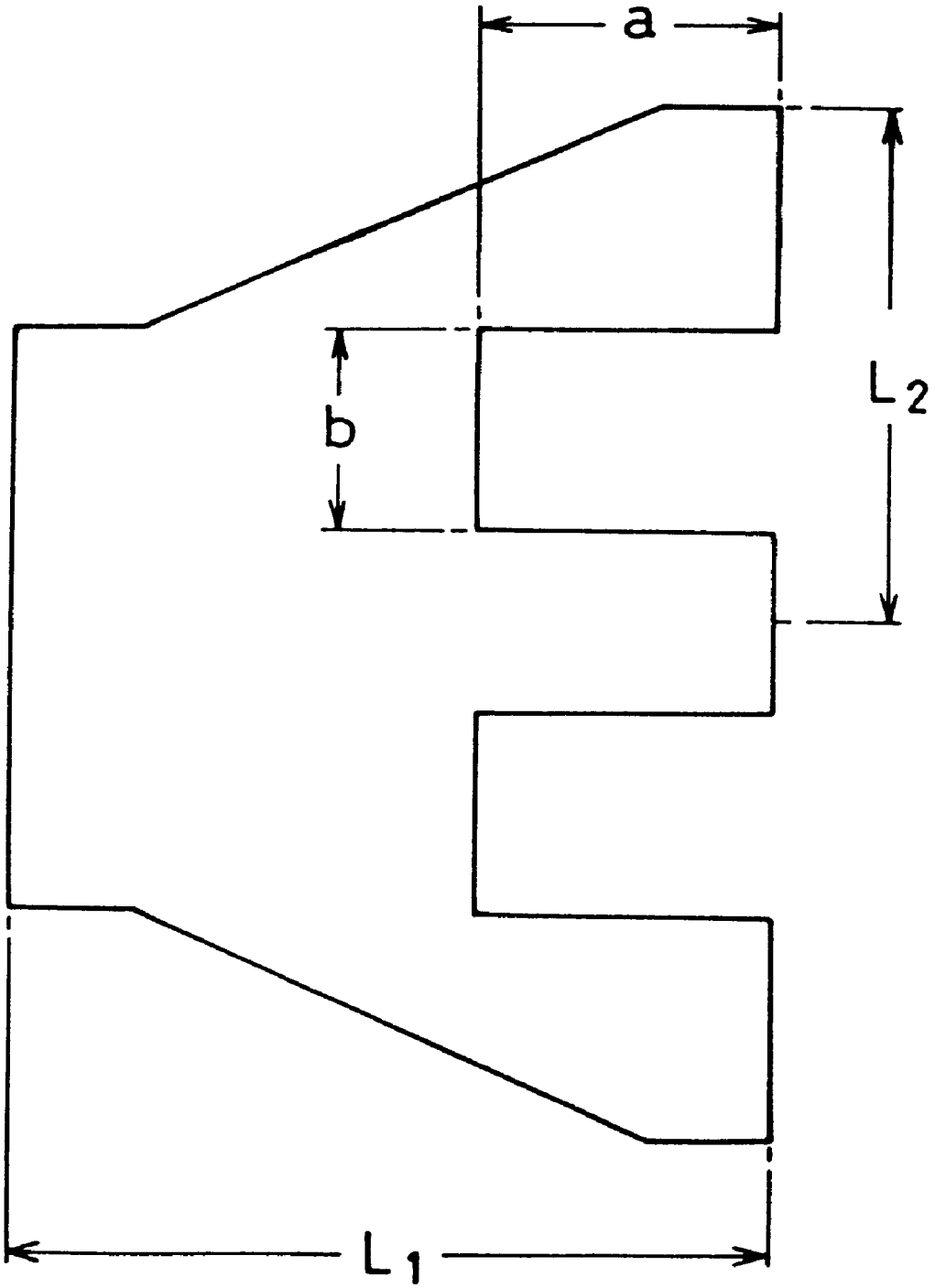
FIG. 16 is a plan view of another embodiment of cores of deflection yokes of Example 6 of the present invention.

Although the notch portions 18 have a half round shape with 10 mm radius in this Example, the size of the radius is not limited thereto and can be selected optionally. Further, the shape of the notch portions is not limited to a half round shape and the same effect can be obtained with an optional shape. In particular, when the notch portions have a rectangular shape as illustrated in FIG. 16, it is preferable that $0<a/L_1 \leqq 0.5$, $0<b/L_2 \leqq 0.5$ ($L_1$: overall length of the core, $2 \cdot L_2$: the maximum horizontal length of the screen side aperture portion of the core, a, b: lengths of the sides of the rectangle).

Although the notch portions 18 are provided as the means to increase the magnetic reluctance in this Example, the notch portions 18 are not prerequisite and if at least a pair of the portions having an electric reluctance greater than that of the right and left portions is provided at the screen side of the core, each in a region away from the horizontal axis by 35 degrees or more, a greater pincushion distortion of the horizontal deflection magnetic field with respect to lines of magnetic force at the screen side of the core results. Other embodiments will be described in the following Example 7 and Example 8.

EXAMPLE 7

Figure 17:
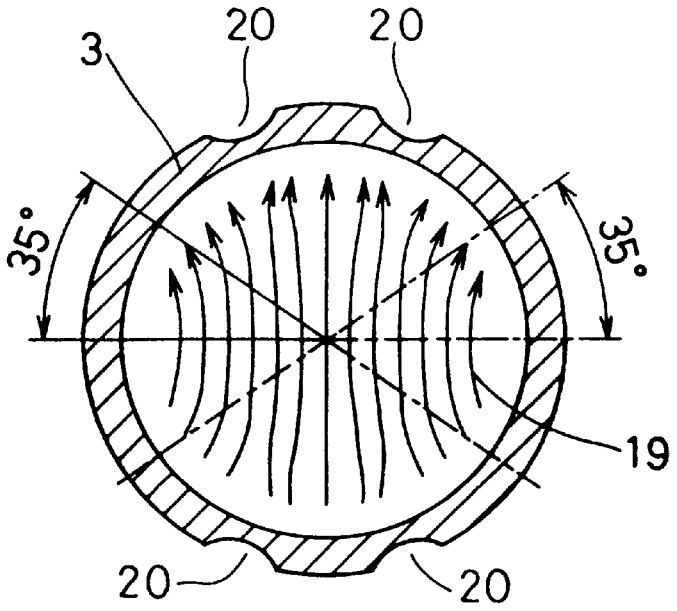
FIG. 17 is a section view of the vicinity of the screen side end of the core of deflection yokes of Example 7 of the present invention.

FIG. 17 is a section view of the vicinity of the screen side end of the core in Example 7 of deflection yokes of the present invention. As described in FIG. 17, the core 3 has a pair of thinner portions 20 provided at the screen side, each in a region away from the horizontal axis by 35 degrees or more. Since other structures are the same as those of the above mentioned Example 6, detailed explanation is omitted (see FIG. 12). Since the magnetic reluctance becomes greater at the thinner portions 20, by having at least a pair of thinner portions 20 provided at the screen side of the core each in a region away from the horizontal axis by 35 degrees or more, lines of magnetic force of the horizontal deflection magnetic field 19 can hardly pass through. As a consequence, the same effect as providing notch portions 18 in the above mentioned Example 6 can be obtained.

EXAMPLE 8

Figure 18:
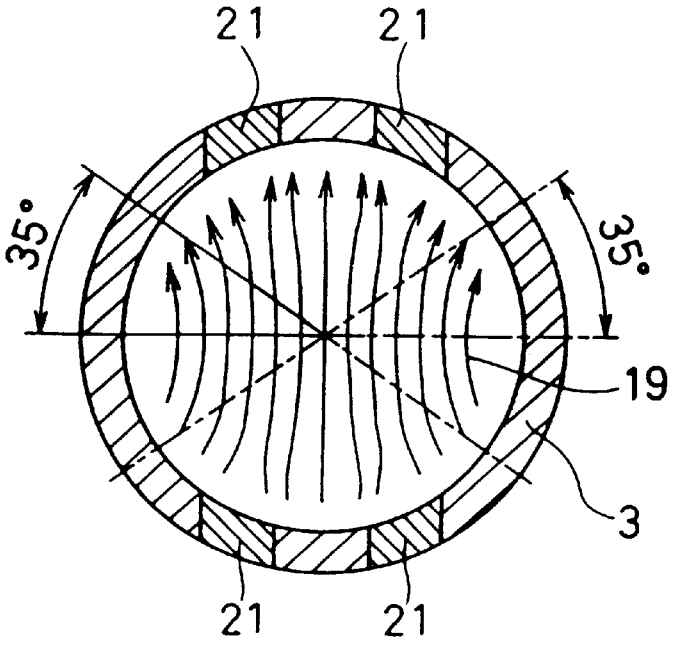
FIG. 18 is a section view of the vicinity of the screen side end of the core of deflection yokes of Example 8 of the present invention.

FIG. 18 is a section view of the vicinity of the screen side end of the core of deflection yokes of Example 8 of the present invention. As described in FIG. 18, the core 3 has a pair of portions having a lower permeability 21 than that of the right and left portions provided at the screen side, each in a region away from the horizontal axis by 35 degrees or more. Since other structures are the same as those of the above mentioned Example 6, detailed explanation is omitted (see FIG. 12). Since the magnetic reluctance becomes greater at the portions 21, by providing the portions having a lower permeability 21 than that of the right and left portions, lines of magnetic force of the horizontal deflection magnetic field 19 can hardly pass through. As a consequence, the same effect as providing notch portions 18 in the above mentioned Example 6 can be obtained.

EXAMPLE 9

Figure 19:
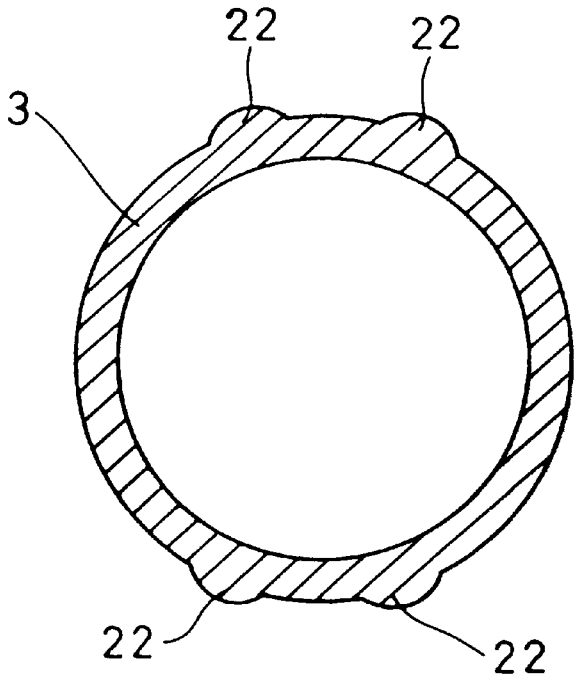
FIG. 19 is a section view of the vicinity of the screen side end of the core of deflection yokes of Example 9 of the present invention.

FIG. 19 is a section view of the vicinity of the screen side end of the core of deflection yokes of Example 9 of the present invention. As described in FIG. 19, the core 3 has a pair of thicker portions 22 provided in the screen side, each in a region away from the horizontal axis by 35 degrees or more. The thicker portions 22 form a half round shape with 10 mm radius. Since other structures are the same as those of the above mentioned Example 6, detailed explanation is omitted (see FIG. 12).

Figure 20:
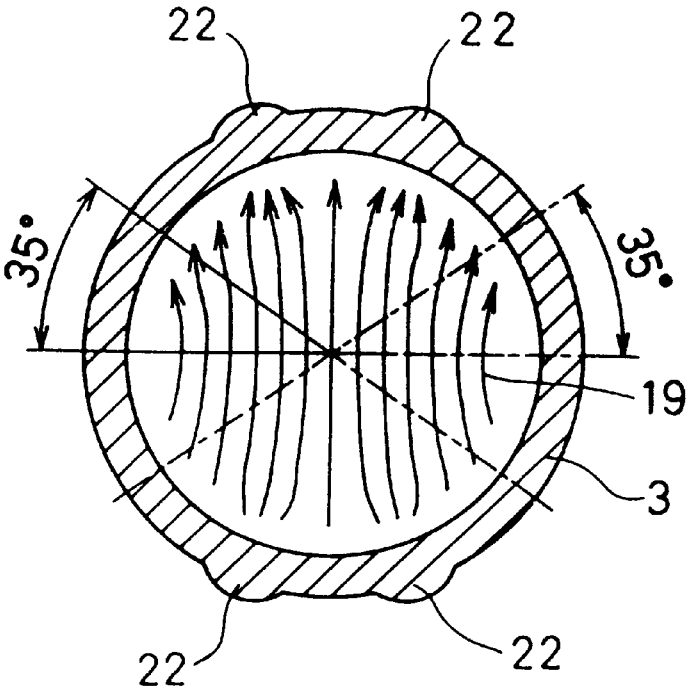
FIG. 20 is a section view of the vicinity of the screen side end illustrating the shape of the pincushion magnetic field of the core and the horizontal deflection coil of Example 9 of the present invention.

The shape of the pincushion magnetic field in the screen side yielded by the horizontal deflection coil 1 with the core 3 having a pair of thicker portions 22 provided in the screen side, each in a region away from the horizontal axis by 35 degrees or more, is illustrated in FIG. 20. FIG. 20 is viewed from the screen side. Since a pair of thicker portions 22 is provided in the screen side of the core in a region away from the horizontal axis by 35 degrees or more and the magnetic reluctance becomes lower at the thicker portions 22, lines of magnetic force of the horizontal deflection magnetic field 19 can hardly pass through. Accordingly the screen side pincushion magnetic field yielded by the horizontal deflection coil 1 with the core 3 curves toward the thicker portions 22 as described in FIG. 20 to reduce the pincushion distortion of the horizontal deflection magnetic field 19. Therefore the magnetic field distribution at the screen side of the horizontal deflection coil can be controlled easily compared with the case with the horizontal deflection coil 1 with a conventional core 3' (FIG. 14). By this arrangement, a high order raster distortion (gullwing) at the upper and lower edges of the screen can be sufficiently reduced without changing the shape of the screen side flange portion of the horizontal deflection coil 1. As a consequence, coil wires of the screen side flange portion can avoid the risk of the damage at the time of winding the horizontal deflection coil 1. Further, since the gullwing can be sufficiently reduced without further comprising a correction magnet, the parts number can be reduced to decrease the production cost and the concern about the magnetization variation of a correction magnet in the production process is eliminated. For example, when the thicker portions 22 comprise a half round shape with 10 mm radius, the gullwing of the image receptor plane of the color television set can be reduced from 1% to almost 0%.

Although the thicker portions 22 comprise a half round shape of 10 mm radius in this Example, the size is not limited thereto and can be selected optionally. Further, the shape of the thicker portions is not limited to a half round shape and the same effect can be achieved with any optional shape such as a rectangular shape.

Although the thicker portions 22 are provided as the means to reduce the magnetic reluctance in this Example, the thicker portions 22 are not prerequisite and as long as at least a pair of the portions having a magnetic reluctance lower than that of the right and left portions are provided at the screen side of the core, each in a region away from the horizontal axis by 35 degrees or more, reduction of the pincushion distortion of the horizontal deflection magnetic field with respect to lines of magnetic force in the screen side core is obtained. Another embodiment is described in the following Example 10.

EXAMPLE 10

Figure 21:
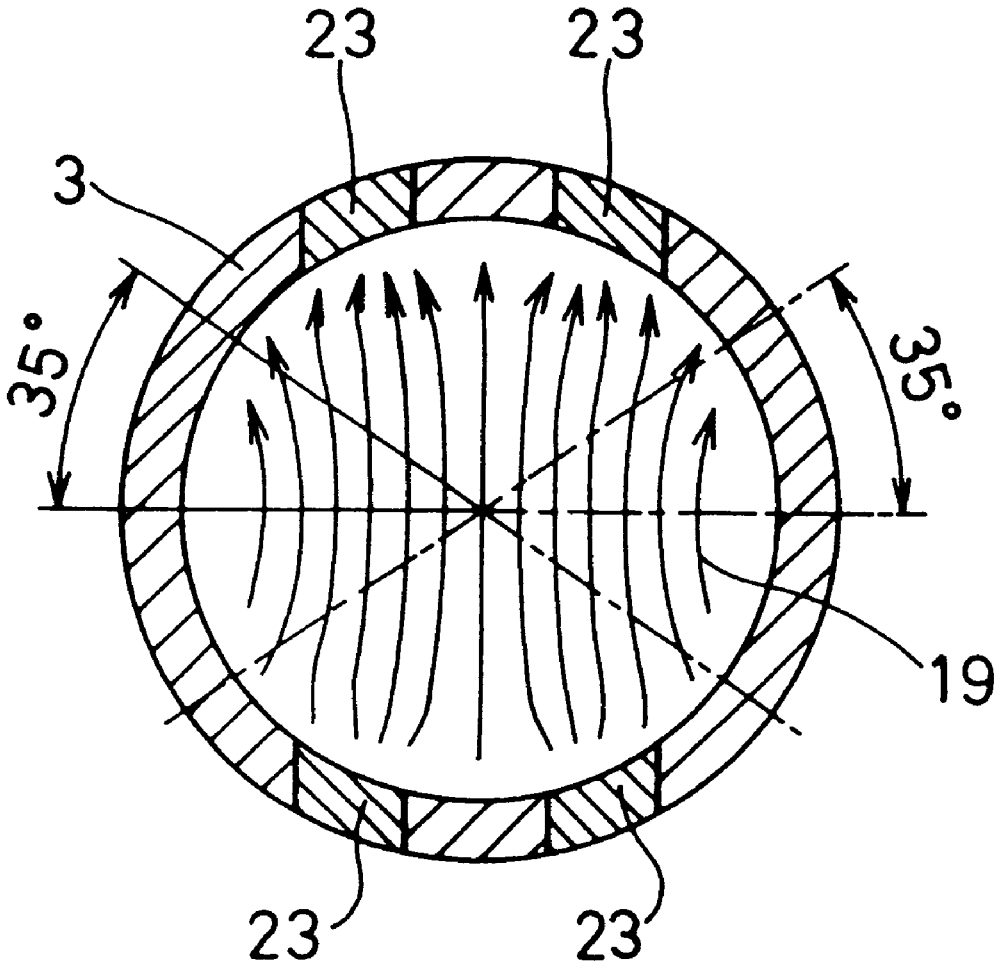
FIG. 21 is a section view of the vicinity of the screen side end of the core of deflection yokes of Example 10 of the present invention.
Figure 22:
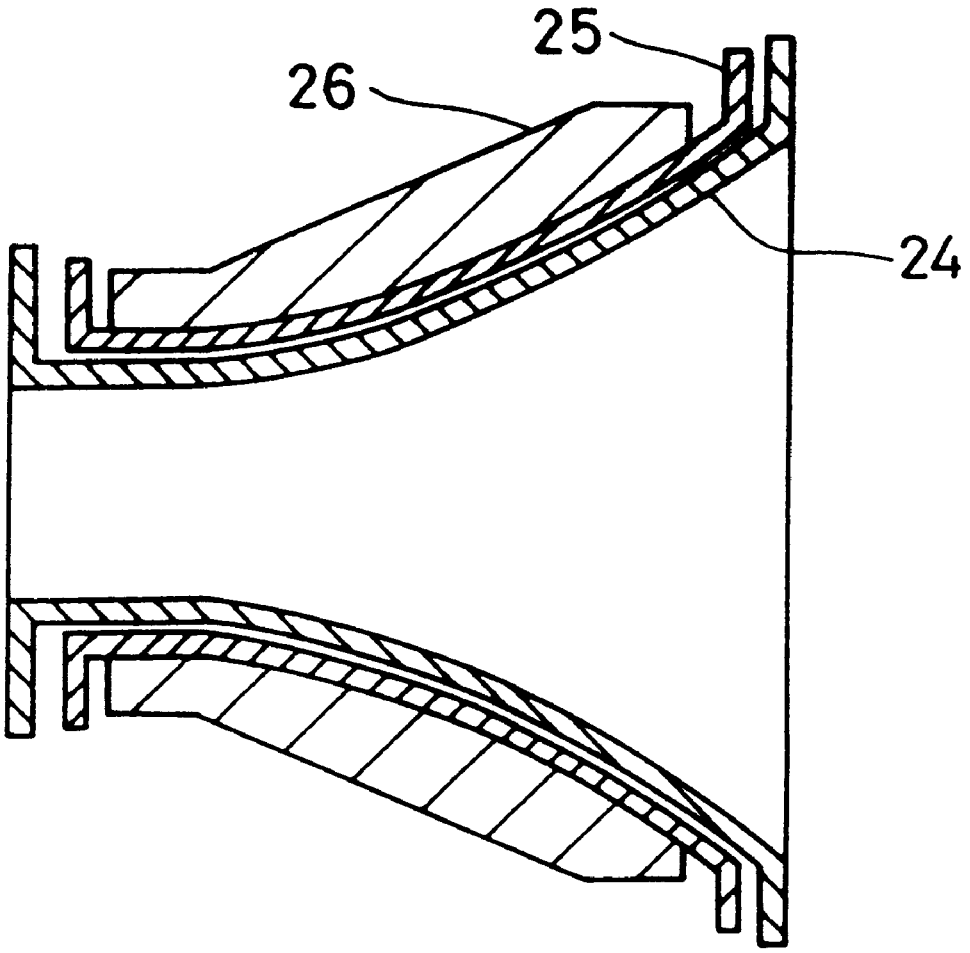
FIG. 22 (PRIOR ART)
FIG. 22 is a side section view of a conventional saddle—saddle shaped deflection yoke.
Figure 23:
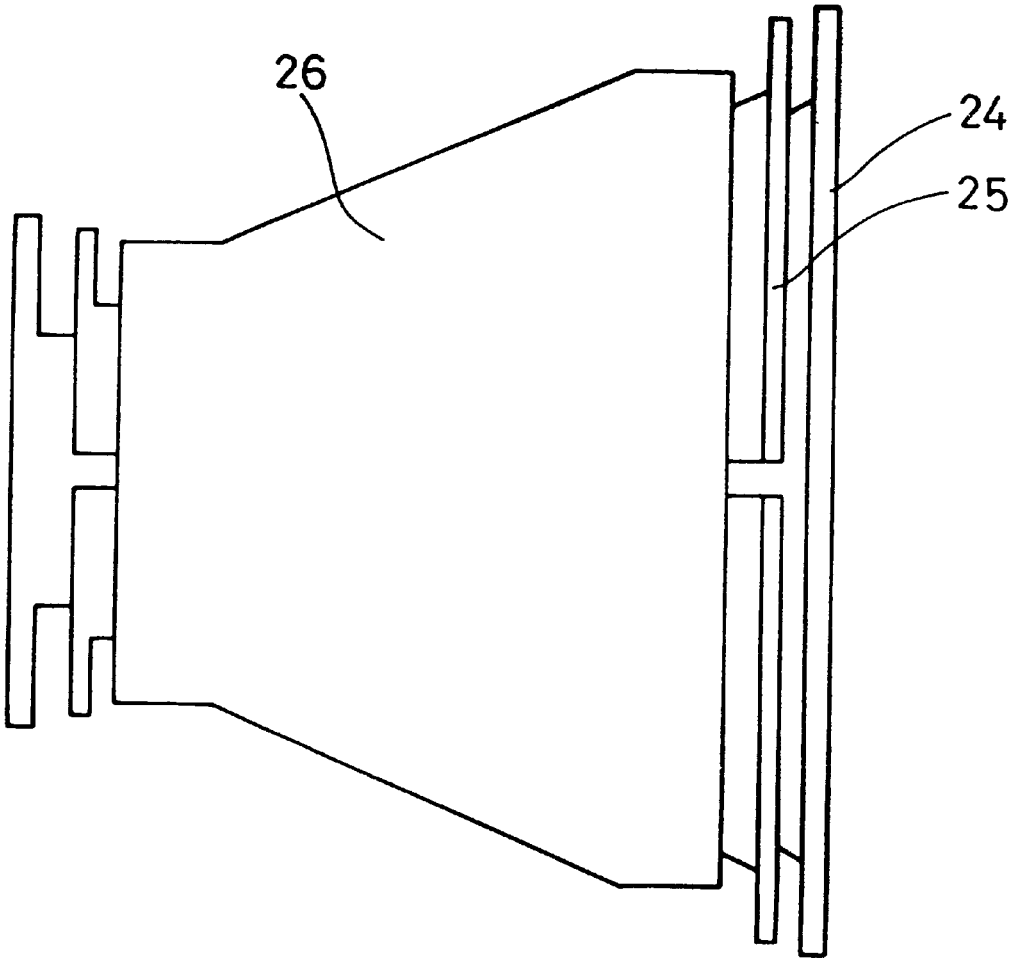
FIG. 23 (PRIOR ART)
FIG. 23 is a plan view of a conventional saddle—saddle shaped deflection yoke.
Figure 24:
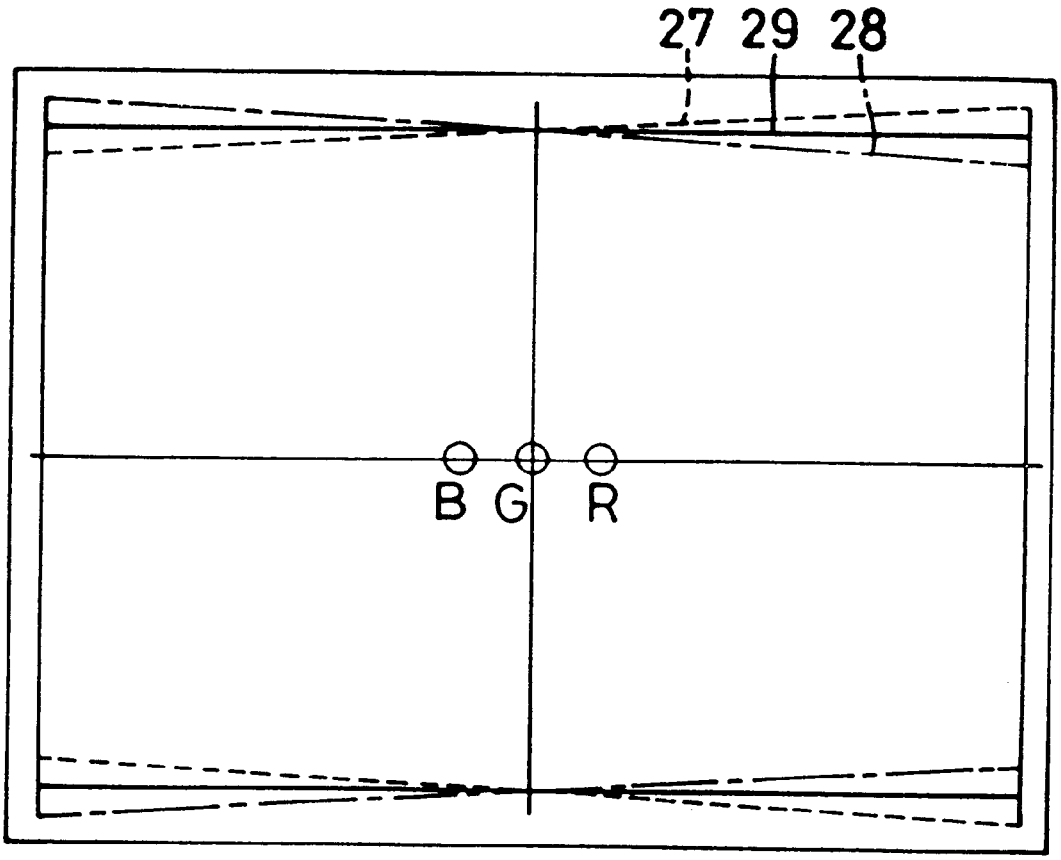
FIG. 24 (PRIOR ART)
FIG. 24 is a diagram illustrating the positive anisotropic astigmatism.

FIG. 21 is a section view of the vicinity of the screen side end of the core of deflection yokes of Example 10 of the present invention. As described in FIG. 21, the core 3 has a pair of portions comprising a material having a high permeability compared with the right and left portions 23 at the screen side, each in a region away from the horizontal axis by 35 degrees or more. Since other structures are the same as the above mentioned Example 6, detailed explanation is omitted (see FIG. 12). By providing a pair of portions comprising a material having a high permeability compared with the right and left portions 23 at the screen side of the core, each in a region away from the horizontal axis by 35 degrees or more, and the magnetic reluctance becomes lower in the portions 23, lines of magnetic force of the horizontal deflection magnetic field 19 can easily pass through. As a consequence, the same effect as the above mentioned Example 9 with thicker portions 22 can be obtained.

EXAMPLE 11

Since the color cathode ray tube used in this Example is the same as that of the above mentioned Example 5, this Example will be explained with reference to FIG. 11. That is, the valve 11 comprises a glass panel 12 and a glass funnel 13 connected to the rear part of the glass panel 12, and an electron gun 14 is provided in the rear part of the glass funnel 13. Further, a self-convergence type deflection yoke comprising a saddle shaped horizontal deflection coil 1, a saddle shaped vertical deflection coil 2 located outside the horizontal deflection coil 1, and a high permeability core 3 located outside the saddle shaped vertical deflection coil 2 is provided at the rear periphery of the glass funnel 13. The core 3 has a pair of notch portions 18 provided at the screen side, each in a region away from the horizontal axis by 35 degrees or more (see FIGS. 12, 13, 15). The notch portions 18 form a half round shape with 10 mm radius. That is, the deflection yoke of the above mentioned Example 6 is used in the color cathode ray tube of this Example. Since the deflection yoke with the structure of the above mentioned Example 6 is used, a high order raster distortion (gullwing) at the upper and lower edges of the screen is sufficiently reduced to improve the image quality of the color cathode ray tube.

Although the embodiment with the deflection yoke of the above mentioned Example 6 is described in this Example, the structure is not limited thereto. Deflection yokes having at least a pair of portions having a magnetic reluctance greater than the right and left portions provided in the screen side of the core, each in a region away from the horizontal axis by 35 degrees or more, to increase the pincushion distortion of the horizontal deflection magnetic field or having at least a pair of portions having a magnetic reluctance lower than that of the right and left portions provided in the screen side of the core in a region away from the horizontal axis by 35 degrees or more to have a pincushion distortion of the horizontal deflection magnetic field with respect to lines of magnetic force in the screen side core can be used as well. For example, deflection yokes of the above mentioned Examples 7 to 10 can be used.

We claim:

1. A self-convergence type deflection yoke comprising a saddle shaped horizontal deflection coil, a saddle shaped vertical deflection coil located outside the horizontal deflection coil and a core having a screen side end and an electron gun side end located outside the saddle shaped vertical deflection coil, wherein at least one pair of portions with a magnetic reluctance lower than that of right and left portions of the screen side end of the core is provided at the screen side of the core, each in a region away from the horizontal axis of the deflection yoke by 35 degrees or more.

2. The deflection yoke according to claim 1, wherein at least one pair of portions with a thickness thicker than that of the right and left portions is provided at the screen side of the core, each in a region away from the horizontal axis of the deflection yoke by 35 degrees or more.

3. The deflection yoke according to claim 1, wherein at least one pair of portions with a permeability higher than that of the right and left portions is provided at the screen side of the core, each in a region away from the horizontal axis of the deflection yoke by 35 degrees or more.

4. A color cathode ray tube comprising a valve which comprises a glass panel and a glass funnel connection to the rear part of the glass panel, an electron gun located in the rear part of the valve, and a self-convergence type deflection yoke comprising a saddle shaped horizontal deflection coil located at the rear periphery of the valve, a saddle shaped vertical deflection coil located outside the saddle shaped horizontal deflection coil and a core having a screen side end and an electron gun side end located outside the saddle shaped vertical deflection coil, wherein at least one pair of portions with a magnetic reluctance lower than that of right and left portions of the screen side end of the core is provided at the screen side of the core, each in a region away from the horizontal axis of the deflection yoke by 35 degrees or more.

5. The color cathode ray tube according to claim 4, wherein at least one pair of portions with a thickness thicker than that of the right and left portions is provided at the screen side of the core, each in a region away from the horizontal axis of the deflection yoke by 35 degrees or more.

6. The color cathode ray tube according to claim 4, wherein at least one pair of portions with a permeability higher than that of the right and left portions is provided at the screen side of the core, each in a region away from the horizontal axis of the deflection yoke by 35 degrees or more.

* * * * *